United States Patent [19]

Hultsch et al.

[11] Patent Number: 4,461,093

[45] Date of Patent: Jul. 24, 1984

[54] APPARATUS FOR DRYING PARTICLES AND METHOD OF OPERATING THE APPARATUS

[75] Inventors: Günther Hultsch, Oberschleissheim; Siegfried Baumgartner, Munich; Harald Bock, Munich; Reinhold Schilp, Munich, all of Fed. Rep. of Germany

[73] Assignee: Krauss-Maffei Aktiengesellschaft, Munich, Fed. Rep. of Germany

[21] Appl. No.: 356,521

[22] Filed: Mar. 9, 1982

[30] Foreign Application Priority Data

Mar. 11, 1981 [DE] Fed. Rep. of Germany ..... 3109140

[51] Int. Cl.[3] ..... F26B 5/08

[52] U.S. Cl. ..... 34/8; 34/10; 34/57 B; 34/57 D; 34/58

[58] Field of Search ..... 34/8, 10, 54, 57 B, 34/57 D, 58, 129, 135

[56] References Cited

U.S. PATENT DOCUMENTS

| | | | |
|---|---|---|---|
| 2,254,867 | 9/1941 | Bonotto | 34/8 |
| 3,500,552 | 3/1970 | Farkas et al. | 34/8 |
| 3,600,817 | 8/1971 | Klein | 34/57 E |
| 4,130,944 | 12/1978 | Hultsch et al. | 34/8 |

FOREIGN PATENT DOCUMENTS

| | | | |
|---|---|---|---|
| 47824 | 10/1920 | Sweden | 34/58 |

*Primary Examiner*—Larry I. Schwartz
*Assistant Examiner*—David W. Westphal
*Attorney, Agent, or Firm*—Karl F. Ross; Herbert Dubno

[57] ABSTRACT

A method of operating a particle-treating apparatus having a hollow foraminous drum centered on and rotatable about an upright axis comprises the steps of feeding particles into the upper portion of the interior of the drum, rotating the drum about the axis at a speed sufficient to form the particles into an annular body lying on the inner surface of the drum, passing a drying gas radially inward through the drum into the interior thereof and withdrawing the gas axially from the interior to at least partially fluidize the body and dry the particles, and collecting the particles beneath the drum as the body moves off the lower edge thereof. The rate of gas flow through the drum and the rotation rate of the drum are such that the body moves axially down in the interior toward the lower edge of the drum. For a batch of particles the drum rotation speed is low at the start of treatment of the batch but is thereafter increased as the batch forms a continuous such body covering substantially all of the interior of the drum to be relatively high.

10 Claims, 2 Drawing Figures

APPARATUS FOR DRYING PARTICLES AND METHOD OF OPERATING THE APPARATUS

FIELD OF THE INVENTION

The present invention relates to an apparatus for treating particles with a gas, and more particular to an apparatus for drying wet particles. In addition this invention concerns a method of operating the apparatus.

BACKGROUND OF THE INVENTION

The gas-treatment or drying of light particles, by which is meant particles with a high surface density or ratio of surface area to mass, with a stream of a drying gas is difficult because an active and effective gas stream will entrain the particles, but a slow gas stream will not work fast enough.

Accordingly, it is known, as for example from U.S. Pat. No. 3,500,552 of D. F. Farkas et al, to dry wet particulate food by feeding the particles into a foraminous drum that is centered on and spun at high speed about a horizontal axis. This creates a centrifuge effect which effectively makes the particles heavier. Thus a high-speed stream of drying gas can be passed through the particles to dry them rapidly without entraining them.

In such a system it is normally necessary to use considerable centrifugal acceleration, normally from 50 meters/second$^2$ to 500 meters/second$^2$, so that a drying-gas stream can flow at an effective rate through the body to dry the particles and partially fluidize it. In machines with horizontal axes, however, this acceleration is increased by the acceleration of gravity, some 9.81 meters/second$^2$, for the particles on the bottom and decreased by it at the top, so that a halting and pulsating movement of the body in the drum is produced.

It is also known, as for example from earlier commonly assigned U.S. Pat. No. 4,130,944 of G. Hultsch et al, to rotate the foraminous drum about an upright axis. The particles are introduced at the bottom of this drum and the gas stream is also moved from bottom to top. Thus the body will move up along the inner surface of the upright drum.

The problem with this style of operation is that when a batch is started there is no bed of particles covering the upper portions of the drum, so that resistance to flow through these upper portions is much lower than the resistance to flow at the lower portion which is covered internally by particles. At low rotation speeds it is difficult to form a body covering the entire inner surface of the drum, but at high speeds a much greater flow of drying gas is needed to fluidize the bed, and such fow is difficult to maintain when a major portion of the drum is offering very little resistance to flow. The normal procedure thus simply keeps feeding in the particles until the drum is virtually full, and then cutting down input until it matches output for steady-state operation.

OBJECTS OF THE INVENTION

It is therefore an object of the present invention to provide an improved particle-treating apparatus.

Another object is the provision of such a particle-treating apparatus which overcomes the above-given disadvantages.

Yet another object is to provide an improved method of operating such an apparatus.

A further object is to provide such a method and apparatus which allow the system to be started up much more easily than has hitherto been possible.

SUMMARY OF THE INVENTION

These objects are attained according to the instant invention in a method of operating a particle-treating apparatus having, as described above, a hollow foraminous drum centered on and rotatable about an upright axis. The method comprises the steps of feeding particles into the upper portion of the interior of the drum, rotating the drum about the axis at a speed sufficient to form the particles into an annular body lying on the inner surface of the drum, passing a drying gas radially inward through the drum into the interior thereof and withdrawing the gas axially from the interior to at least partially fluidize the body and dry the particles, and collecting the particles beneath the drum as the body moves off the lower edge thereof. The rate of gas flow through the drum and the rotation rate of the drum are such that the body moves axially down in the interior toward the lower edge of the drum. The use of an upright drum with top-to-bottom passage of the particles means that, even when the system is started up, the force of gravity will be working for rather than against the formation of an annular particle body covering the whole length of the drum. In addition with an upright axis the force of gravity is equally effective at all times on all of the particles.

According to another feature of this invention, for a batch of particles the drum rotation speed is low at the start of treatment of the batch but is thereafter increased to be relatively high as the batch forms a continuous such body covering substantially all of the interior of the drum. This procedure makes the system start and get into steady-state operation faster than has been hitherto possible.

In addition the drying gas of this invention is withdrawn axially and downward from the drum, thereby moving concurrent with the body. The gas and particles can therefore be separated from each other below the drum simply by sucking the air in at the axis below the drum and collecting the particles as they scatter out when they fall off the bottom of the drum.

The apparatus according to this invention comprises a hollow drum adapted to receive wet particles and having a foraminous wall of circular cross section centered on an upright axis, inlet means for admitting the particles to the upper portion of the interior of the drum and drive means for rotating the drum and particles therein about the axis at an angular rate sufficient to urge the particles radially out with a centrifugal force against the inner surface of the drum. In addition a housing spacedly surrounds the drum and defines a space around the drum to which a blower means supplies a drying gas that then passes at least partially radially inward through the foraminous wall and generally opposite to the centrifugal force. Control means is connected to at least one of the drive and blower means for regulating the respective rate such that the body continuously forms and moves down in the drum from the upper portion to the lower edge thereof where it continuously falls from the drum.

In accordance with yet another feature of this invention the wall of the drum is upwardly frustoconically tapered in the upper portion and generally cylindrical therebelow. The inlet means includes an upwardly flared generally frustoconical plate centered on the axis generally axially level with the upper portion and fixed rotationally to the drum, and means for depositing the particles axially on the plate, whereby the particles are thrown outward and upward from the plate. This last-mentioned means can simply be a fill tube extending up along the axis from a location immediately above the deflector plate.

The drum according to this invention may also be provided with a downwardly flared and axially centered extension having an upper edge attached to the lower edge of the drum and a lower edge, a substantially cylindrical and axially centered extension having an upper edge attached to the lower edge of the downwardly flared extension and a lower edge, and a downwardly tapered and axially centered extension extending down from the lower edge of the cylindrical extension. Axially extending ribs are angularly spaced about on the cylindrical extension. In this arrangement the blower means includes an outlet conduit extending axially up in at least the downwardly tapered extension and spaced inward therefrom. This effects an extremely efficient separation of the dried particles from the drying-gas stream.

In accordance with yet another feature of this invention the apparatus has a housing surrounding the drum and forming therearound at the wall a blowing compartment and below the drum with a separating compartment. The blower means is connected to the blowing compartment for admitting drying air thereto and includes an outlet conduit extending into the separating compartment for withdrawing the drying air therefrom. The particles can simply be collected in the bottom of the separating compartment below the mouth of the outlet conduit, to which end the outlet compartment must have a diameter at the lower edge of the drum that is greater than that of this lower edge, to throw the particles centrifugally outward.

DESCRIPTION OF THE DRAWING

The above and other features and advantages will become more readily apparent from the following, reference being made to the accompanying drawing in which.

SPECIFIC DESCRIPTION

Figure 1:
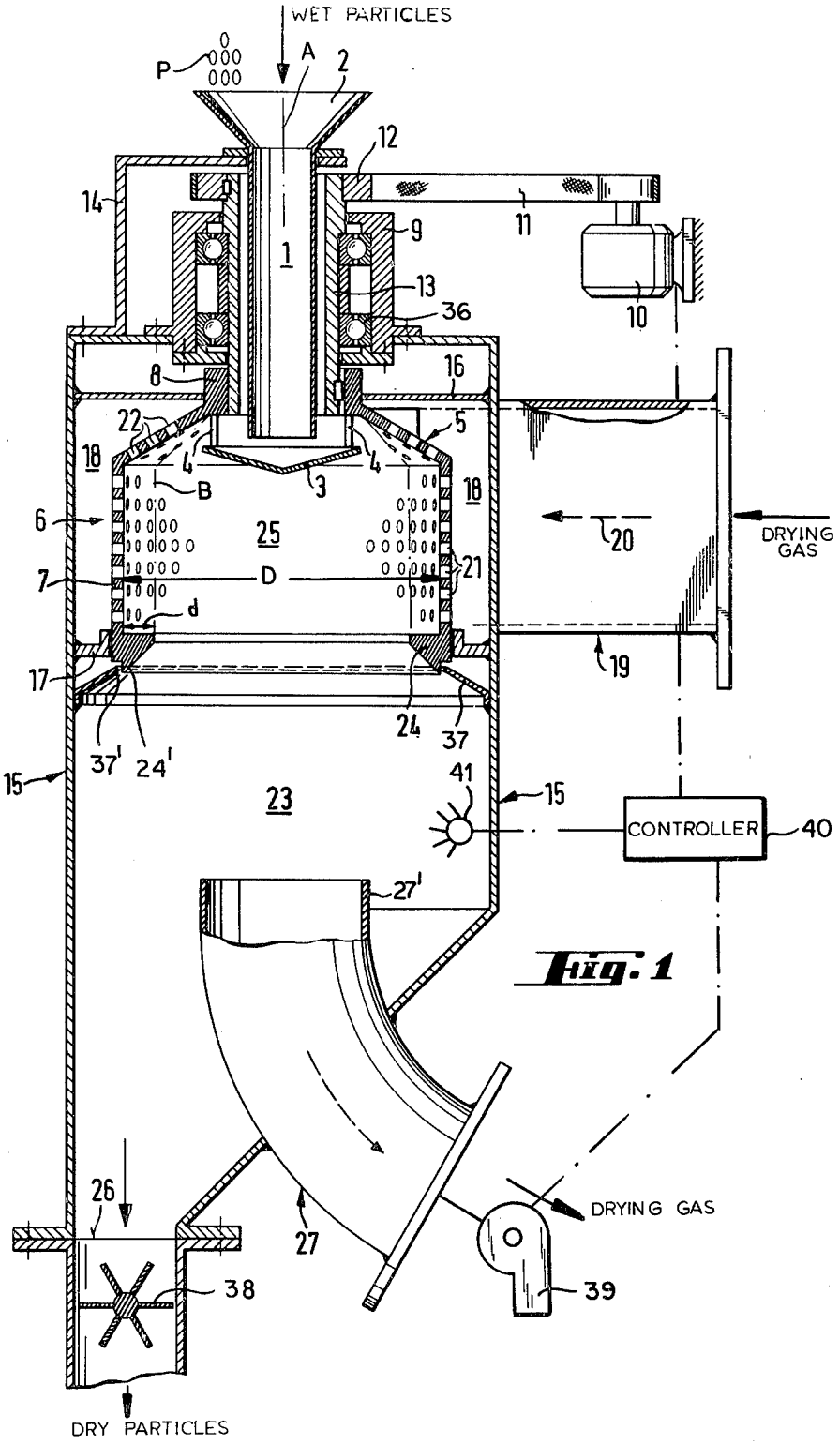
FIG. 1 is an upright axial section through an apparatus for carrying out the method of this invention.

As seen in FIG. 1, an apparatus according to this invention has a cylindrical and upright inlet tube 1 centered on an axis A and formed at its upper end with an inlet funnel 2 into which wet particles P are loaded. Arranged underneath the lower end of the tube 1 is an upwardly concave frustoconical deflector plate 3 of greater outside diameter than the tube 1 and supported by axially extending struts 4 on the upwardly tapered frustoconical upper wall portion 5 of a perforated drum 6 having a cylindrical lower wall portion 7.

At its upper end this drum 6 has an annular hub 8 keyed to the lower end of a tubular drive shaft 13 carried by roller bearings 36 in a journal housing 9 for rotation about the axis A. The upper end of this tubular drive shaft 13 carries a pulley 12 connected via a flat belt 11 to an electric motor 10 so that this motor 10 can rotate the entire drum 6 with the deflector plate 3 about the axis A.

The bearing support 9 and a support strut 14 for the feed tube 1 are carried on an upright housing 15 that has a pair of horizontal partition walls 16 and 17 defining an annular chamber 18 surrounding the drum 6 between its upper and lower ends. A large inlet conduit 19 can feed a drying gas, such as warm air, radially or tangentially as indicated by arrow 20 into the compartment 18. This drying gas can pass radially inward into the interior 25 of the drum 6 through holes 21 and 22 in the drum portions 7 and 5, respectively.

At its lower end the drum 6 has a radially inwardly projecting rim 24 that extends in a distance d equal to about one-eighth the diameter D of the drum 6. Below this rim 24 the housing 15 is formed with an upwardly tapered frustoconical skirt 37 forming a downward continuation of the rim 24, but having an upper edge 37' that extends slightly upward beyond the lower edge 24' of the rim 24.

Formed in the housing 15 below the drum 6 is a compartment 23 formed at its lower end with an outlet 26 provided with a cell-type unloading valve 38. An outlet conduit 27 opens axially upward into the compartment 23 and is connected to a blower 39 to pull the drying gas out of the compartment 23. The conduit 27 has a circular upper end 27' centered on the axis A and spaced somewhat down from the lower end of the drum 6.

In use the motor 10 rotates the drum 6 first at a low speed, then at high speed. The blower 39 meanwhile sucks drying gas in as shown at 20 into the compartment 18, then through the perforations 21 and 22 into the interior 25 of the drum 6, and finally axially down into the compartment 23 to exit from the drum via the conduit 27.

Wet particles P are loaded into the funnel 2 at the upper end of the tube 1. These particles drop down onto the rotating plate 3 which throws them radially out against the upper wall portion 5 of the drum 6. This forms the particles into an annular body whose outline is indicated at B and which lies on the inner surface of the drum 6, with the gas passing radially in through the holes 21 and 22 serving to fluidize the body B and dry the particles. At the start of treating a batch of particles, that is when the drum 6 is empty, the rotation speed is kept low so that the body of particles forms quickly, then it is raised to a relatively high level once substantially the entire inner surface of the drum 6 is covered by the body B. The body B in the drum 6 will have a radial depth equal generally to d. Gravity causes this body B to slide down inside the drum 6 until it can flow over the rim 24.

The axial advance speed is a function of particle mass, particle size, drum size, drum-rotation speed, and the rate of flow of the drying gas. At least the last three of these factors can be controlled by the manufacturer of the device so that by the time the particles P slide over the rim 24 they are completely dry. In fact according to this invention a controller 40 is connected to the drive motor 10 and to the blower 39 to vary either the drum rotation rate--normally the peripheral speed-or the flow rate--normally the mass/time rate--of the drying gas stream passing through the apparatus. Such a controller 40 may be operated by a sensor, such as a photocell arrangement 41 that detects how quickly the particles P are being collected in the chamber 23.

Figure 2:
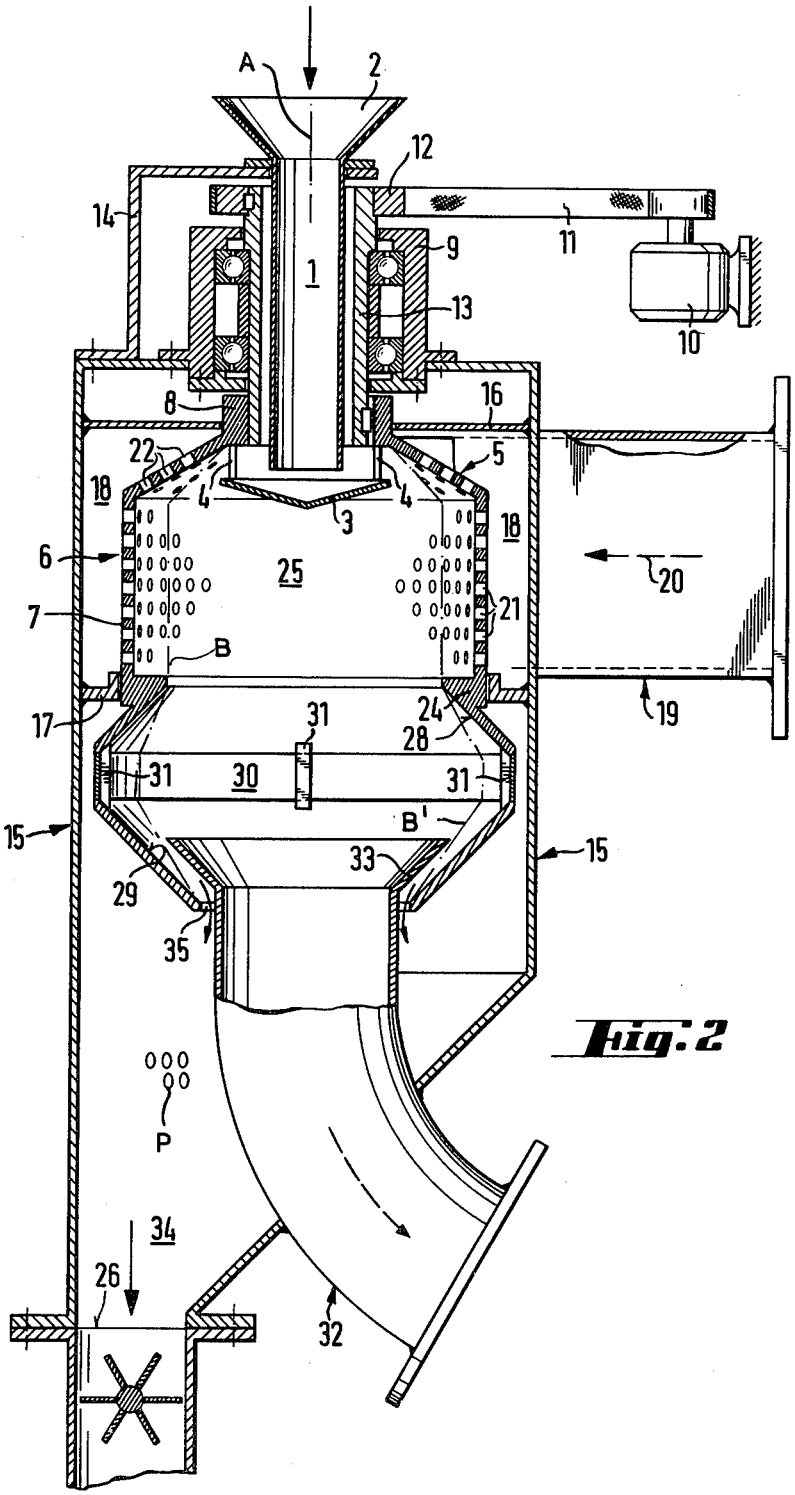
FIG. 2 is a section identical to FIG. 1 but showing a variant on the FIG. 1 apparatus.

The arrangement of FIG. 2 is substantially indentical to that of FIG. 1 except that the wall 37 is dispensed with and the rim 24 is formed with a frustoconical downwardly flared extension 28. A cylindrical portion 30 having four axially extending and angularly equispaced ribs 31 is connected to and forms a continuation of the lower end of the extension 28, and itself carries a downwardly tapered frustoconical extension or portion 29. The elements 28–30 are not foraminous like the drum 6.

The outlet conduit 27 of FIG. 1 is replaced in FIG. 2 by an outlet conduit 32 having an upper end formed by a funnel 33 centered on the axis A and spaced inward and upward from the portion 29 to form a space 35 therewith. An outlet compartment 34 having the outlet 26 is formed underneath the drum extension 28–31.

In this arrangement the particles, once they have passed over the rim 24, are flung centrifugally out against the inner surface of the extension 28 and then against the inner surface of the cylindrical portion 30 whose ribs 31 entrain the particles angularly. This forms a rapidly rotating annular body B′ of particles in the extension 28–31 which is moved by gravity down to flow out through the space 35 into the outlet compartment 34. This two-stage operation ensures excellent drying with minimal entrainment of particles in the gas pulled out of the device.

Either system of the instant invention will effect rapid and efficient treating of a particles with a gas. Although the discussion above was limited to drying wet particles with a gas, it is of course possible to carry out other treatment operations, such as curing, heating, cooling, or chemically altering particles with an appropriate gas. The invention is not limited to drying and this term should be considered to apply to similar operations where particles are treated by contact with a gas. The particles being can easily be separated from the treatment gas according to this invention so that this treatment gas can be recirculated or simply vented to the atmosphere if desired.

We claim:

1. A method of operating a particle-treating apparatus having a hollow foraminous drum centered on and rotatable about an upright axis, said method comprising the steps of:

feeding particles into the upper portion of the interior of said drum;

rotating said drum about said axis at a speed sufficient to form said particles into an annular body lying on the inner surface of said drum;

passing a drying as radially inward through said drum into the interior thereof and withdrawing said gas axially from said interior to at least partically fluidize said body and dry said particles, the rate of gas flow through said drum and the rotation rate of said drum being such that said body moves axially down in said interior toward the lower edge of said drum, this moving down being assisted by gravity of said particles; and collecting said particles beneath said drum as said body moves off said lower edge thereof.

2. The method defined in claim 1 wherein for a batch of particles, the drum rotation speed is low at the start of treatment of the batch but is thereafter increased as the batch forms a continuous such body covering substantially all of the interior of said drum to be relatively high.

3. The method defined in claim 1 wherein said drying gas is withdrawn axially and downward from said drum, thereby moving concurrent with said body.

4. The method defined in claim 3, further comprising the step of separating said gas from said particles below said drum, thereby utilizing the centrifugal force upon said particles rotating about said axis.

5. An apparatus for drying particles, said apparatus comprising:

a hollow drum adapted to receive wet particles and having a foraminous wall of circular cross section centered on an upright axis, inlet means for admitting said particles to the upper portion of the interior of said drum;

drive means for rotating the drum and particles therein about said axis at an angular rate sufficient to urge said particles radially outward with a centrifugal force against the inner surface of said drum;

a housing spacedly surrounding said drum and defining a space around said drum; and blower means for passing a drying gas through said space at a flow rate and at least partially radially inward through said foraminous wall and generally opposite to the centrifugal force; and control means connected to at least one of said drive and blower means for regulating the respective rate such that said body continously forms and moves down in said drum from said upper portion to the lower edge thereof where it continuously falls from said drum.

6. The apparatus defined in claim 5 wherein said foraminous wall is upwardly frustoconically tapered in said upper portion and generally cylindrical therebelow.

7. The apparatus defined in claim 5 wherein said inlet means includes an upwardly flared generally frustoconical plate centered on said axis generally axially level with said upper portion and fixed rotationally to said drum, and means for depositing said particles axially on said plate, whereby said particles are thrown outward and upward from said plate.

8. The apparatus defined in claim 5 wherein said drum is provided with:

a downwardly flared and axially centered extension having upper and lower edges, the former being attached to said lower edge of said drum;

a substantially cylindrical and axially centered extension having upper and lower edges, the former being attached to said lower edge of said downwardly flared extension;

axially extending ribs angularly spaced about on said cylindrical extension; and a downwardly tapered and axially centered extension extending down from said lower edge of said cylindrical extension.

9. The apparatus defined in claim 8 wherein said blower means includes an outlet conduit extending axially up in at least said downwardly tapered extension and spaced inward therefrom while said particles are discharged through said space.

10. The apparatus defined in claim 5, further comprising a housing surrounding said drum and forming thereround at said wall a blowing compartment and below said drum with a separating compartment, said blower means being connected to said blowing compartment for admitting drying air thereto and including an outlet conduit extending into said separating compartment for withdrawing said drying air therefrom while said particles being dried fall downwardly radially outside said conduit.

* * * * *